US007422227B2

(12) United States Patent
Riedel et al.

(10) Patent No.: US 7,422,227 B2
(45) Date of Patent: Sep. 9, 2008

(54) SKI BINDING FOR CROSS COUNTRY OR TELEMARK SKI

(76) Inventors: Tilo Riedel, Laufener Str. 15 A, Freilassing (DE) D083395; Bernt-Otto Hauglin, Fossumvn. 2, Royken (NO) N-3440

( * ) Notice: Subject to any disclaimer, the term of this patent is extended or adjusted under 35 U.S.C. 154(b) by 0 days.

(21) Appl. No.: 11/633,109

(22) Filed: Dec. 1, 2006

(65) Prior Publication Data

US 2007/0126204 A1 Jun. 7, 2007

Related U.S. Application Data

(62) Division of application No. 10/477,052, filed as application No. PCT/IB02/01644 on May 7, 2002, now Pat. No. 7,207,591.

(30) Foreign Application Priority Data

May 8, 2001 (DE) ..... 101 22 187
May 22, 2001 (DE) ..... 101 24 893

(51) Int. Cl.
*A63C 7/00* (2006.01)
*A63C 7/10* (2006.01)

(52) U.S. Cl. ..... 280/605; 280/604; 280/601

(58) Field of Classification Search ..... 280/604, 280/605, 611, 613–623, 627, 633, 634
See application file for complete search history.

(56) References Cited

U.S. PATENT DOCUMENTS 2,072,477 A 3/1937 Dodd
2,576,639 A 11/1951 Purvis
3,418,004 A 12/1968 Welker
3,432,180 A 3/1969 Suhner
3,447,812 A 6/1969 Kato
4,088,342 A 5/1978 Hausleithner
4,163,569 A * 8/1979 Horn ..... 280/605
4,196,921 A * 4/1980 Sherwin ..... 280/615
4,322,090 A * 3/1982 Loughney ..... 280/614

(Continued)

FOREIGN PATENT DOCUMENTS

DE 3412073 C1 10/1985

(Continued)

*Primary Examiner*—Christopher Ellis
*Assistant Examiner*—Vaughn T Coolman
(74) *Attorney, Agent, or Firm*—Andrus, Sceales, Starke & Sawall, LLP

(57) ABSTRACT

Ski binding (1; 1'; 1"), in particular touring, telemark or cross-country binding, with a front retaining element associated with the front sole end (7*a*) of a ski boot (5), a back retaining element (21) so constructed that it engages an edge (7*b*) at the front part of the boot sole or at the heel of the boot, and a tensioning device (17; 25; 47; 17'; 17") that connects the front and back retaining elements to one another, and that allows the front and back retaining elements to be locked to the ski boot and, in particular in the locked state, allows the heel of the boot to be raised away from the ski, wherein the front retaining element grips the sole of the ski boot on both sides near the tip of the boot, in particular with lateral resilience, and with the front retaining element there is associated an elastic pressing element (13) to press the upper side of the sole against the retaining element.

2 Claims, 8 Drawing Sheets

U.S. PATENT DOCUMENTS

Figure 1:
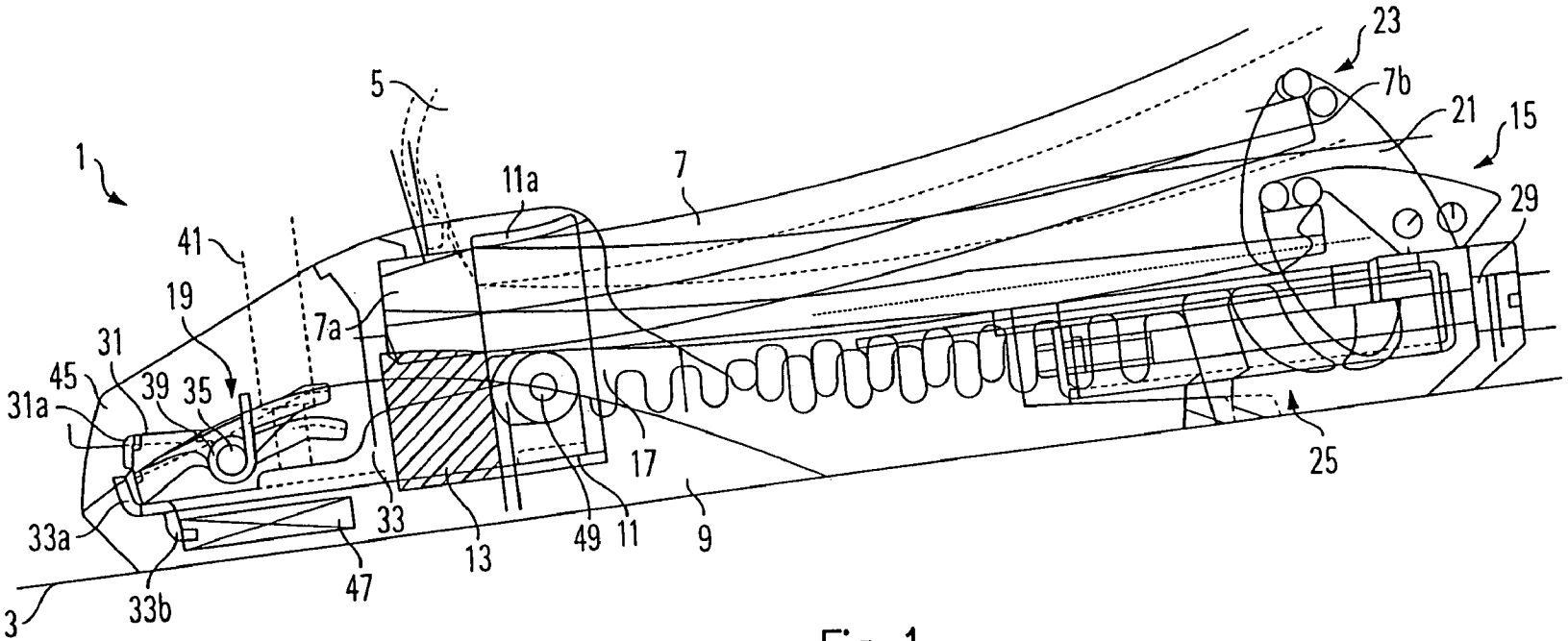

| | | | | | |
|---|---|---|---|---|---|
| 4,498,685 | A | * | 2/1985 | Zoor | 280/605 |
| 4,536,006 | A | * | 8/1985 | Haldemann et al. | 280/613 |
| 4,871,186 | A | * | 10/1989 | Klosterman | 280/611 |
| 4,887,833 | A | | 12/1989 | Bailey | |
| 5,088,757 | A | | 2/1992 | Hauglin | |
| 5,108,125 | A | | 4/1992 | Callegari | |
| 5,190,309 | A | | 3/1993 | Spitaler et al. | |
| 5,228,714 | A | | 7/1993 | Dekanovsky | |
| 5,362,088 | A | | 11/1994 | Rohrmoser | |
| 5,794,963 | A | | 8/1998 | Girard | |
| 5,897,127 | A | | 4/1999 | Hauglin | |
| 6,308,979 | B1 | * | 10/2001 | Ludlow | 280/615 |
| 6,402,184 | B1 | | 6/2002 | Hauglin | |
| 6,431,578 | B2 | * | 8/2002 | Pedersen et al. | 280/626 |
| 6,644,683 | B1 | | 11/2003 | Hauglin et al. | |
| 2003/0168830 | A1 | | 9/2003 | Hauglin | |

FOREIGN PATENT DOCUMENTS

| | | | |
|---|---|---|---|
| DE | 3412073 | C2 | 8/1989 |
| DE | 100 31 775 | A1 | 10/2001 |
| EP | 0 806 977 | A1 | 11/1997 |
| EP | 0806 977 | B1 | 7/1999 |
| FR | 02 741 543 | A | 5/1997 |
| FR | 2 779 659 | B1 | 9/2000 |
| WO | WO 00/04965 | A | 2/2000 |
| WO | WO 01/66204 | A | 9/2001 |
| WO | WO 01/93963 | A | 12/2001 |

* cited by examiner

SKI BINDING FOR CROSS COUNTRY OR TELEMARK SKI

CROSS-REFERENCE TO RELATED APPLICATIONS

The present application is a divisional of U.S. patent application Ser. No. 10/477,052, filed Jun. 1, 2004 now U.S. Pat. No. 7,207,591, which application is the U.S. national stage application of International Application Ser. No. PCT/IB02/01644, filed May 7, 2002, which was published on Nov. 14, 2002, as International Publication No. WO 02/089931. The International Application claims priority of German Patent Application No. 101 22 187.8, filed May 8, 2001, and German Patent Application No. 101 24 893.8, filed May 22, 2001.

The invention relates to a ski binding according to the precharacterizing clause of claim 1.

Bindings for touring, telemark or cross-country skiing differ from downhill bindings in a crucial functional feature, namely that whereas in both cases the front end of the boot sole is fixed to the ski, in the former bindings the back end of the sole (the heel) should not be fixed to the ski, but must be attached in such a way that it can be raised from the ski surface. This elementary requirement, necessitated by the movement sequences that occur during cross-country or touring skiing or while travelling downhill in telemark style, has in the past usually been achieved by binding constructions that involve some impairment of the guidance function of the binding.

For years, however, even cross-country, touring and telemark bindings have been known, and put into practical use, in which the binding and an appropriately constructed ski boot are provided with corresponding sections that engage one another and thus achieve a good lateral guidance, at least when the boot is resting on the ski binding.

The patent DE 34 12 073 C2 discloses a cross-country safety ski binding in which a flexible plate attached to the ski with a rotary bearing in a posterior position guides the ski boot laterally relatively well even when the boot is raised up from the ski and, furthermore, in principle permits the retaining mechanism to be disengaged when the ski boot is placed under torsional load. For the sliding phase, in which the boot is set onto the ski, additional stabilising elements are provided.

The patent EP 0 806 977 B1 discloses a ski binding according to the precharacterizing clause of claim 1. In an advantageous embodiment this ski binding comprises a tensioning element that engages the underside of the front part of the boot sole and that in particular is constructed as a flexurally elastic part in the form of a band or leaf spring.

This ski binding offers good guidance and force-transmission properties, but even here there is a need for improvement, in particular with respect to its safety properties and to simple operation with little expenditure of force.

In the applicant's unpublished German patent application 100 31 775.8 a ski binding of this generic kind that has been improved in these respects is described in a number of different embodiments. This binding releases the ski boot not only when manually actuated (to step off the ski) but also when unacceptably high torsional force is applied to ski or boot. Furthermore, it provides safety and utility properties that represent considerable advances in comparison to the known ski bindings.

The present invention thus has as its objective to develop such a generic ski binding still further, with the goal of creating an easily operated safety ski binding for cross-country or touring use as well as for downhill skiing in telemark style.

This objective is achieved with respect to a first aspect of the invention by a ski binding with the characteristics given in claim 1, and with respect to a second, relatively independent aspect by a ski binding with the characteristics given in claim 12.

Elastically flexible construction of the clamp that forms the first retaining element advantageously enables the front tip of the ski boot to be rotated out of the binding when the torsional force between ski and boot is unacceptably high, and thus in an extremely simple manner implements a safety aspect of the proposed ski binding that is crucial for skiing downhill. The invention includes the fundamental idea of designing the front retaining element as a clamp that is structurally simple and simultaneously stable, enclosing the sole of the boot from both sides near the boot tip. It further includes the idea that to facilitate an anatomically and physiologically advantageous sequence of movements while skiing, this retaining element is associated with an elastic pressing element, which presses the sole against the retaining clamp but because of its elastic characteristics can be pushed down by the boot tip when the heel is raised while skiing.

In a design preferred from the viewpoint of manufacturing technology, the retaining element is constructed as a retaining clamp made of metal (in particular steel) or a highly stable plastic and having a substantially U-shaped cross section, such that the ends of the arms of the "U" are bent inward and form sections that engage the upper side of the boot sole in its front part. The base of this retaining clamp is next to the ski and is attached thereto, i.e. to a base plate of the ski binding. The pressing element is preferably constructed as an elastomer block which during use is situated under the sole of the ski boot and which preserves its elastic qualities even at low temperatures. The elastomer block is advantageously positioned ahead of or partially within the retaining clamp. It can also have an upper surface that, in particular towards the end of the ski, slants slightly downward and/or exhibits a slight spherical curvature in longitudinal section.

In another preferred embodiment an unlocking device is provided, attached to the tensioning device that connects the front and back retaining elements (or situated in the region of the front and/or back retaining element); in response to manual actuation—in particular pressure from above—this unlocking device releases the tension in the tensioning device and allows the ski boot to be removed from the binding.

Owing to the provision of an actuating element that unlocks the above-mentioned form-fitting locking mechanism in response to the application of force along an axis, the operation of this ski binding is considerably simplified in comparison to the known locking and tensioning devices of the top-dead-centre type. For the user, this results in an additional substantial advantage.

The tensioning device in a preferred embodiment comprises a flat connecting part that can be elastically bent in a longitudinal sectional plane of the ski binding. In particular, this part consists of a flexible plastic plate that connects the front and back retaining elements together, at least indirectly, and that provides a supplementary means (in addition to the elastic flexibility of the connecting part itself) of allowing a degree of spring-loaded movement in the long direction of the ski. The flat connecting part runs along the side of the ski and in particular is guided by means of the side walls of a binding case attached to the ski, which enclose sections of the side edges of the connecting part, at least in the front region.

In the region of the front or back retaining element or also between them is disposed a spring device to apply tension that keeps the back retaining element locked to the ski boot—in a further preferred embodiment, specifically to the front part of the boot sole. In particular, between the front and the back locking element is provided a front spring device, the force of which keeps the first locking element in a position such that it engages the second locking element, whereas at the back retaining element there is a back spring device, the force of which keeps the back retaining element in a position such that it engages the front part of the boot sole (or also the back edge of the heel).

The two spring devices cooperate when the binding is being locked and unlocked, and the spring force exerted by the back device is greater than that of the front device. Hence when the engagement between the first and second locking elements is released, the tensioning device along with the back retaining element mounted thereon is pulled slightly backward under the action of the back spring device and against the (weaker) action of the front spring device. As a result, the engagement that locks the back retaining element to the corresponding section of the boot sole is broken (the "release" state) and the boot can be pivoted out of the binding. However, as soon as the boot has left the binding, the back spring device is no longer under tension, whereupon the front spring device can exert its action and guide the engagement element back into the longitudinal position in which a renewed engagement with the second locking element becomes possible. The binding is then again in the "step-in" state.

It is advantageous for a ski brake also to be integrated into the proposed ski binding, so that the binding is equipped with substantially the full set of properties for use of a downhill binding, and thus is suitable even for the case in which the ski becomes released during downhill skiing in telemark style. The ski brake is provided in the known manner with an actuating section that is in direct contact with the underside of the front part of the boot sole and is pressed against the latter under spring tension. When the ski boot is not (any longer) in the ski binding, this actuating section can spring freely upward, as a result of which the ski brake is activated.

In a particularly simple and reliably functioning embodiment the brake is constructed as a resilient pivoted lever, which pivots about an axis located in its middle region, and the front end of which constitutes the actuating section, whereas its back end is bifurcated to form "claws" that extend along the sides of the ski and represent the actual effective section of the ski brake. The actuating section is advantageously inserted into an opening in the flat connecting part, in or near the median axis of the ski binding. In an especially advantageous design, the brake is pivotably fixed to the base plate of the binding, and its front end (actuating section) extends beyond a front axle of the flat connecting part. There it is reliably fixed in place by the front end of the ski boot even when the heel of the boot is raised, and rotates into its active position only when the boot leaves the binding.

So that the length changes associated with raising and lowering of the boot heel are compensated by flexion of the tensioning device—in particular the flat connecting part—spring means are preferably provided at the back retaining element. In an especially advantageous design this function is served by the above-mentioned back spring device, which additionally provides the spring tension that locks the back retaining element into place.

There are further provided at the back retaining element—or in an alternative construction also in the region of the front retaining element—adjustment means to adjust the length of the binding; these advantageously comprise a sliding piece disposed in a longitudinal guide means, where it can be fixed in position (for example, with a locking screw).

The front spring device in a preferred construction consists of a coil spring compressible over a long distance, which abuts at one end against a binding mounting plate and is connected at the other end to the (second) unlocking device, and serves as a compression-spring element. This compression-spring element applies tension that keeps the second locking element engaged with the first locking element. This engagement is released (as mentioned elsewhere) by applying pressure from above to the first locking element, so that the skier can step out of the binding.

At the first locking element is provided in particular a restoring torsion-spring element and/or a lever device with a pivoted lever, which can be rotated into a closed position—in particular by means of the torsion-spring element—and into the open position by pressing on a suitably disposed and shaped actuating section.

At least in the region of the front retaining element or the tensioning device, the flat connecting element is constructed as a bearing plate for the front part of the boot sole, which advantageously has a rough contour on its underside, to avoid impairment of its function owing to an accumulation of snow. In the embodiment of the invention in which a back retaining element engages the front part of the boot sole, behind that element there is additionally provided a bearing element for the boot heel—which advantageously also has a rough surface contour.

Figure 2:
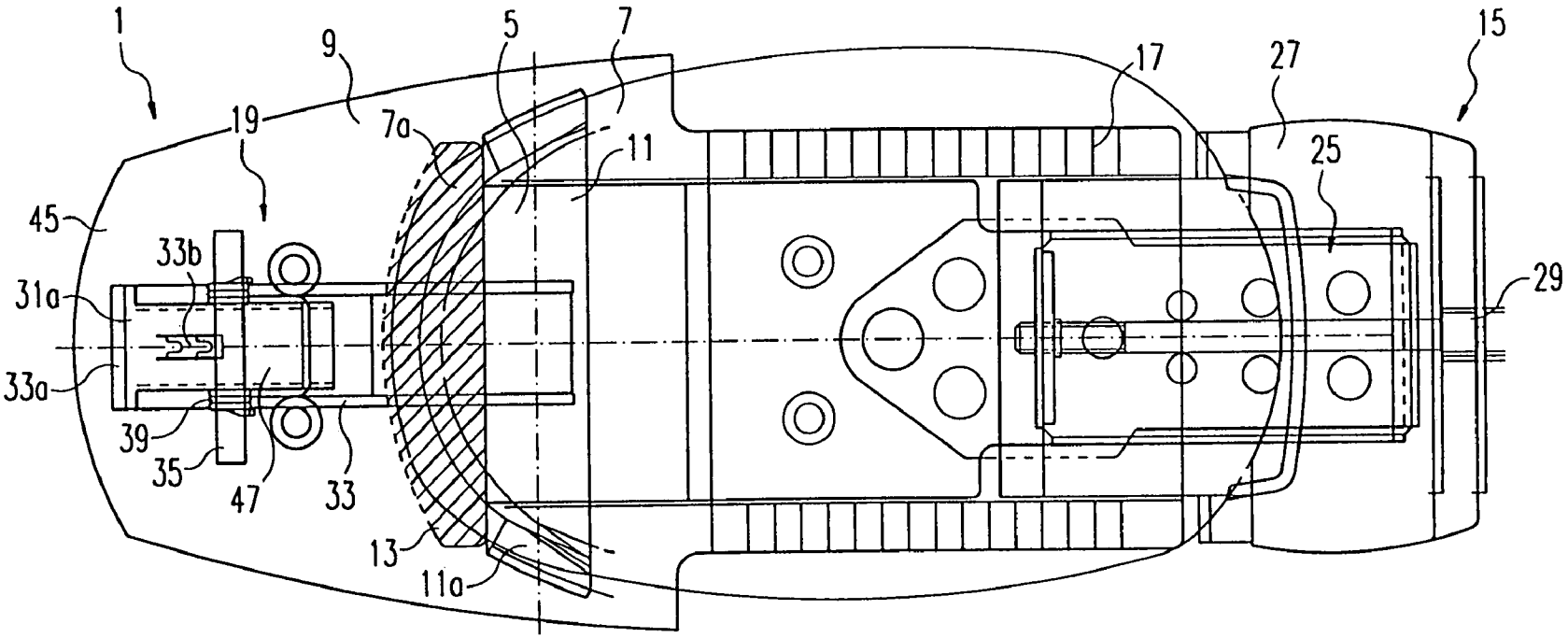
Figure 3:
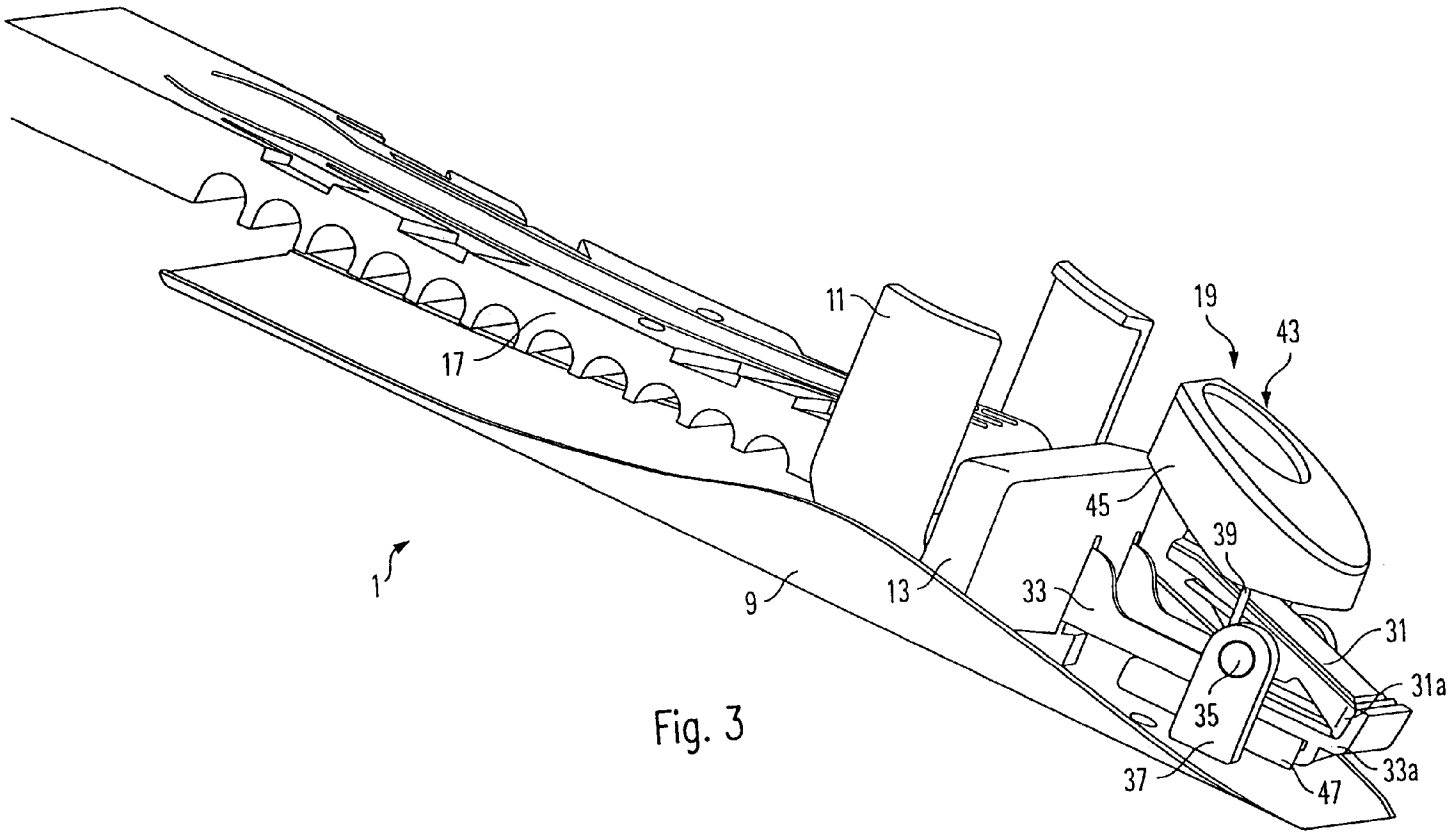
Figure 4:
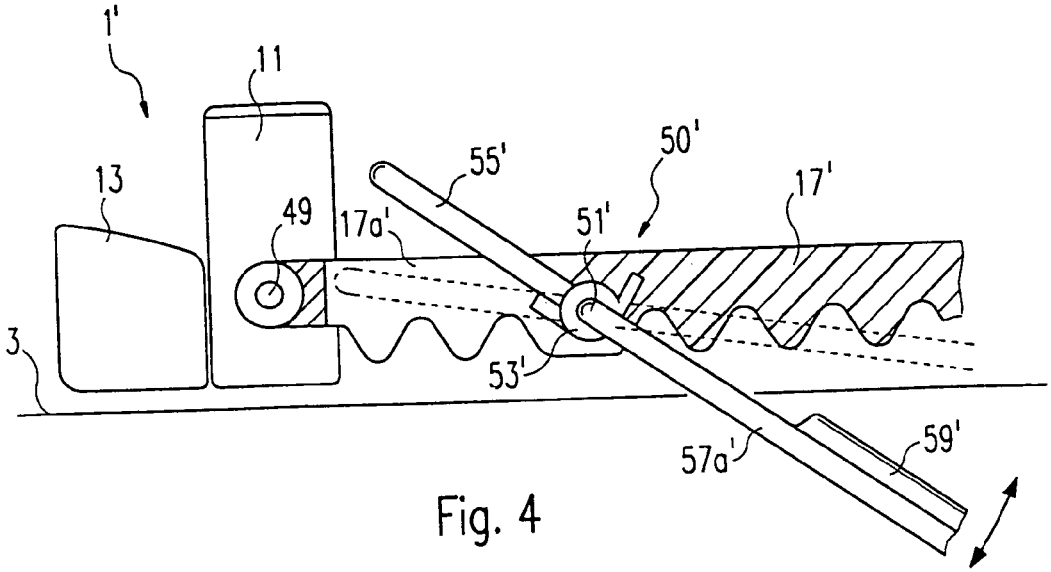
Figure 5:
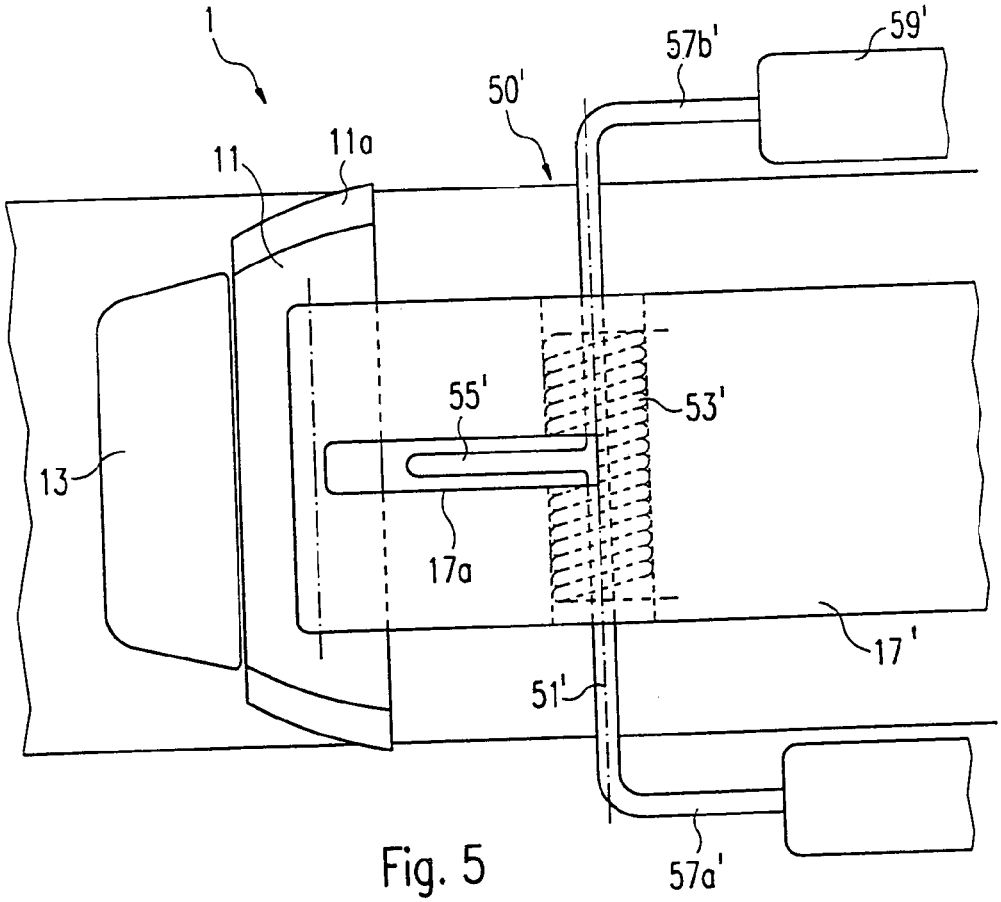
Figure 6:
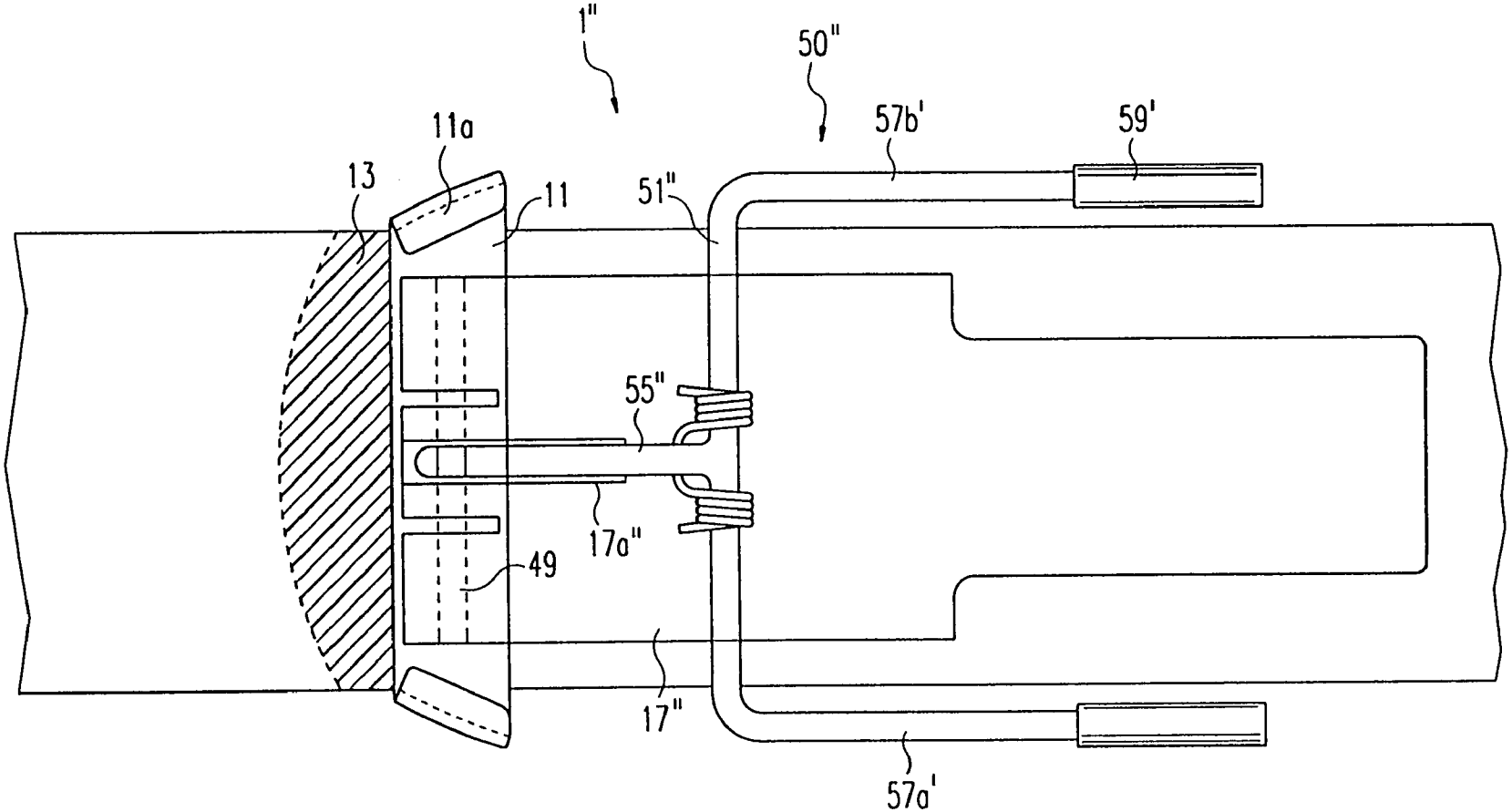

Other advantages and useful features of the invention will be apparent from the subordinate claims and from the following description of preferred exemplary embodiments with reference to the figures, wherein FIG. 1 is a synoptic illustration of a ski binding according to one embodiment of the invention, shown as a combination of side view and longitudinal section in a vertical plane, in which two different positions of the front part of the boot sole are diagrammed, FIG. 2 is another illustration of the ski binding according to FIG. 1 in the form of a plan view combined with partial longitudinal sections in a plane parallel to the ski surface, FIG. 3 is a perspective view of the main structural elements of the ski binding according to FIGS. 1 and 2 (without binding case), FIG. 4 is a sketch of the same type as in FIG. 1, to make clear the basic construction of a ski binding of the kind shown in FIGS. 1 to 3 when modified by addition of a ski brake, FIG. 5 is a sketch similar to that in FIG. 2 (plan view) of the ski binding according to FIG. 4, and FIGS. 6 and 7A-7C are sketches showing, in plan view, a slight modification of the ski binding according to FIGS. 4 and 5, as well as three side views with a ski boot in various positions.

FIGS. 1 and 2 show a ski binding 1 according to a first embodiment of the invention as it appears when installed on a ski (not shown) pointing leftwards (i.e., its tip should be imagined to the left of the drawings and its back end to the right). FIG. 3 shows the essential components of the front part of the ski binding 1 again, in a three-dimensional representation. In FIG. 1 the continuous line at the bottom indicates the upper surface 3 of the ski, and the lower part of the front of a ski boot 5 is shown in two positions: when the boot is completely lowered and when its heel is slightly raised. The boot 5 has a front sole 7 with a projecting circumferential edge 7*a* and a back edge 7*b*, which is engaged by major functional elements of the ski binding 1 (further details below).

The ski binding 1 comprises as its main functional units a mounting plate 9, a front retaining element 11 with associated elastic pressing element 13, a back retaining mechanism 15, a flexible plastic plate 17 that connects the front retaining element 11 to the back retaining mechanism 15, and an unlocking device 19 disposed ahead of the front retaining element.

The front retaining element 11 is constructed as a resilient steel retaining clamp with a substantially U-shaped cross section, such that the limbs of the "U" comprise inwardly bent edges 11*a* by means of which the retaining clamp 11 grips the edge 7*a* of the boot sole 7 on both sides. As can best be seen in FIGS. 2 and 3, the retaining clamp 11 is somewhat broadened towards the back, to adapt it to the shape of the front sole of the boot. Because it is made of a resilient material, when an unacceptably large torsional force is applied between boot and ski, it can expand elastically so as to allow the front sole part 7 to rotate out of the retaining clamp 11, so that the ski boot 5 is released from the binding 1 and thus from the ski.

The elastic pressing element 13, which in the embodiment shown here is disposed immediately ahead of the retaining clamp 11 and is designed as a massive elastomer block, the upper surface of which is slightly convex and slants slightly downward towards the back, is in direct contact with the lower surface of the front sole part 7, so that it presses the upper surface of the sole edge 7*a* against the lower surface of the inwardly directed clamp edges 11*a* and thus generates a frictional resistance that counteracts rotation of the boot 5 about an axis perpendicular to the ski surface. The effect thereby achieved is that rotation of the ski boot is possible only when relatively large lateral forces are imposed, and the boot 5 can rotate out of the binding only when the lateral forces are dangerously high. The elastomer block 13 thus ensures reasonable guidance properties of the binding while simultaneously fulfilling a safety-release function. Furthermore, the elastomer block 13 opposes raising of the heel of the ski boot 5 by applying an elastic resistance to the tip of the sole 7, and the restoring force so generated is biodynamically desirable when such raising occurs.

The back retaining mechanism 15 will be described here only in rough outline, as it is not one of the central features of the invention. It comprises a spring-loaded pivoted lever 21, which engages the back end 7*b* of the sole by way of a pair of rollers 23. By making a pivoting movement, the lever 21 (which in FIG. 1 1 is shown in two rotational positions) follows the movement caused by raising the heel of the boot 5 to a certain degree without causing the pair of rollers 23 to be come disengaged from the back sole end 7*b*. A back spring device 25, which is embedded in a retaining-device housing 27, pulls the back retaining element 21 against the back sole end 7*b*. An adjustment screw 29 is used to adjust the back retaining mechanism 15.

The unlocking device 19 used to open the binding has substantially two components: a pivoted lever under torsional-spring loading as first locking element 31, and a sliding piece 33 under compression-spring loading as second locking element. The two parts 31, 33 are both approximately U-shaped in cross section and each has at its front end a tilted edge 31*a*, 33*a* to serve as a catch section for engagement with its counterpart.

The pivoted lever 31, which constitutes the first locking element, can be rotated about an axle 35 mounted in a U-shaped holder 37. A coil spring 39 is wound around the axle 35 and acts as a torsion spring, exerting a force to keep the lever 31 engaged with the sliding piece 33. When pressure is applied from above with a ski pole 41 (indicated by dashed lines in FIG. 1), which can be inserted through a guide opening 43 in a front binding case 45, the pivoted lever 31 can be rotated clockwise far enough that its tilted edge 31*a* becomes disengaged from the tilted edge 33*a* of the sliding piece 33.

The second locking element (sliding piece) 33 comprises, in addition to the above-mentioned first, upwardly directed edge 33*a*, a second tilted edge 33*b* that points downward and projects into a front spring device (coil spring) 47. The force exerted by the spring 47 pushes the sliding piece 33 forward, into a position where it engages the pivoted lever 31. The sliding piece 33 passes through the elastomer block 13, in which two slots (not labeled separately) are provided for this purpose, and at its end the retaining clamp 11 is connected to the plastic plate 17, by way of an axle 49 for both fixation and rotation. The plate is flexurally elastic but not extensible, with the net result that a high-tensile-strength connection is formed between the front end of the sliding piece 33 (the tilted edge 33*a*) and the back retaining mechanism 15. As long as the pivoted lever 31 and the sliding piece 33 are locked together, an elasticity of the binding in the long direction for the purpose of flexion compensation is implemented exclusively by the torsion-spring loading of the back retaining element 21.

However, when a ski pole 41 is used to apply pressure from above on the pivoted lever 31 as previously described, so that the lever becomes disengaged from the sliding piece 33, then the back spring device 25 pushes the back retaining mechanism 15 as a whole (and with it the plastic plate 17 and the sliding piece 33) backwards until the engagement with the back sole end 7*b* of the boot 5 is released and the skier can step out of the binding. After this has occurred, the front spring device 47 can press the sliding piece 33 forward again, and with it (by way of the fixation axle 49) the plastic plate 17, so that the engagement with the lever 31 is restored and the binding is ready for a boot to be re-inserted.

The schematic sectional drawings in FIGS. 4 and 5 show a ski binding 1 that has basically the same construction as shown in FIGS. 1 to 3 but has been modified by the additional provision of a ski brake 50'. The other parts of the binding 1' shown here are identified by the same reference numerals as in FIGS. 1 to 3.

The ski brake 50' resembles the first locking element 31 in that it is constructed as a spring-loaded pivoted lever with an axle 51' in the middle region, around which is disposed a torsion spring 53'. The axle 51' is formed by a middle section of the pivoted lever 50' that is oriented transverse to the ski axis; towards the tip of the ski the lever ends in a front section 55' consisting of a single part, and towards the back end of the ski it bifurcates to form two branches 57*a*', 57*b*', disposed so that one is on each side of the ski. To each of these branches is fixed a plastic pad 59' to expand the surface of the branch 57*a*', 57*b*' and increase its resistance in the snow.

The front section 55' projects into the plastic plate 17' within a slot-like opening 17*a*'. When no ski boot is placed on the plate, the force of the torsion spring 53' raises the front section 55' so that it slants upward from the ski, which activates the ski brake 50'. However, if a boot is in the binding, the underside of its sole presses the front section 55' downward and hence raises the side branches 57*a*', 57*b*', so that they are pulled up beyond the running surface of the ski and the ski brake is inactive.

FIGS. 6 and 7A to 7C show a ski binding 1" modified from the preceding design, in which most parts correspond to those in the design according to FIGS. 4 and 5; these parts are identified by the same reference numerals as in those drawings.

This ski binding 1" has a ski brake 50" in the form of the spring-loaded pivoted lever already shown in FIGS. 4 and 5, but here the brake is disposed in a mounting plate 9" on the upper surface 3 of the ski.

The pivoted lever 50" in this case is bent at an angle in the region of the axle 51" and its front section 55" is so long that it extends beyond the fixation and rotation axle 49 of the flexible plastic plate 17". The longitudinal slot 17*a*" in the latter is correspondingly elongated. The front end of the front section 55" is curved slightly downward in a somewhat hook-like shape, to adjust it to the cross-sectional configuration of the fixation and rotation axle 49.

Figure 7A:
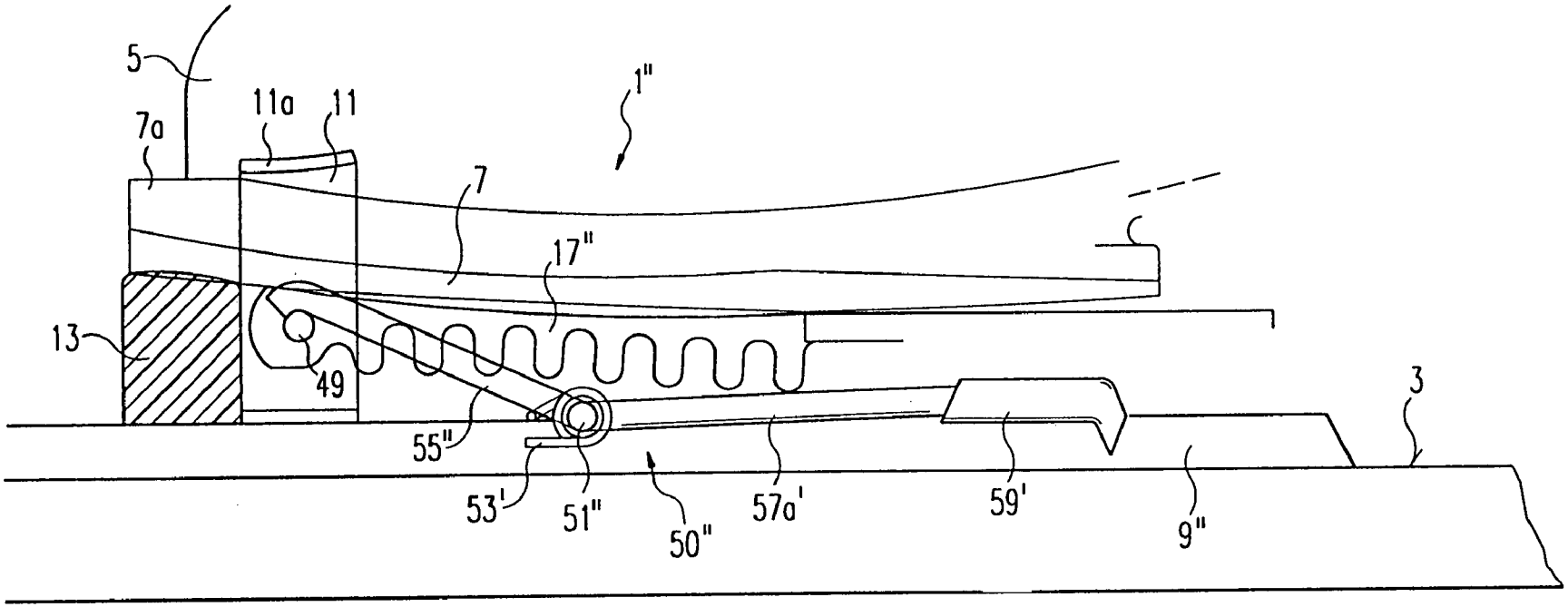
Figure 7B:
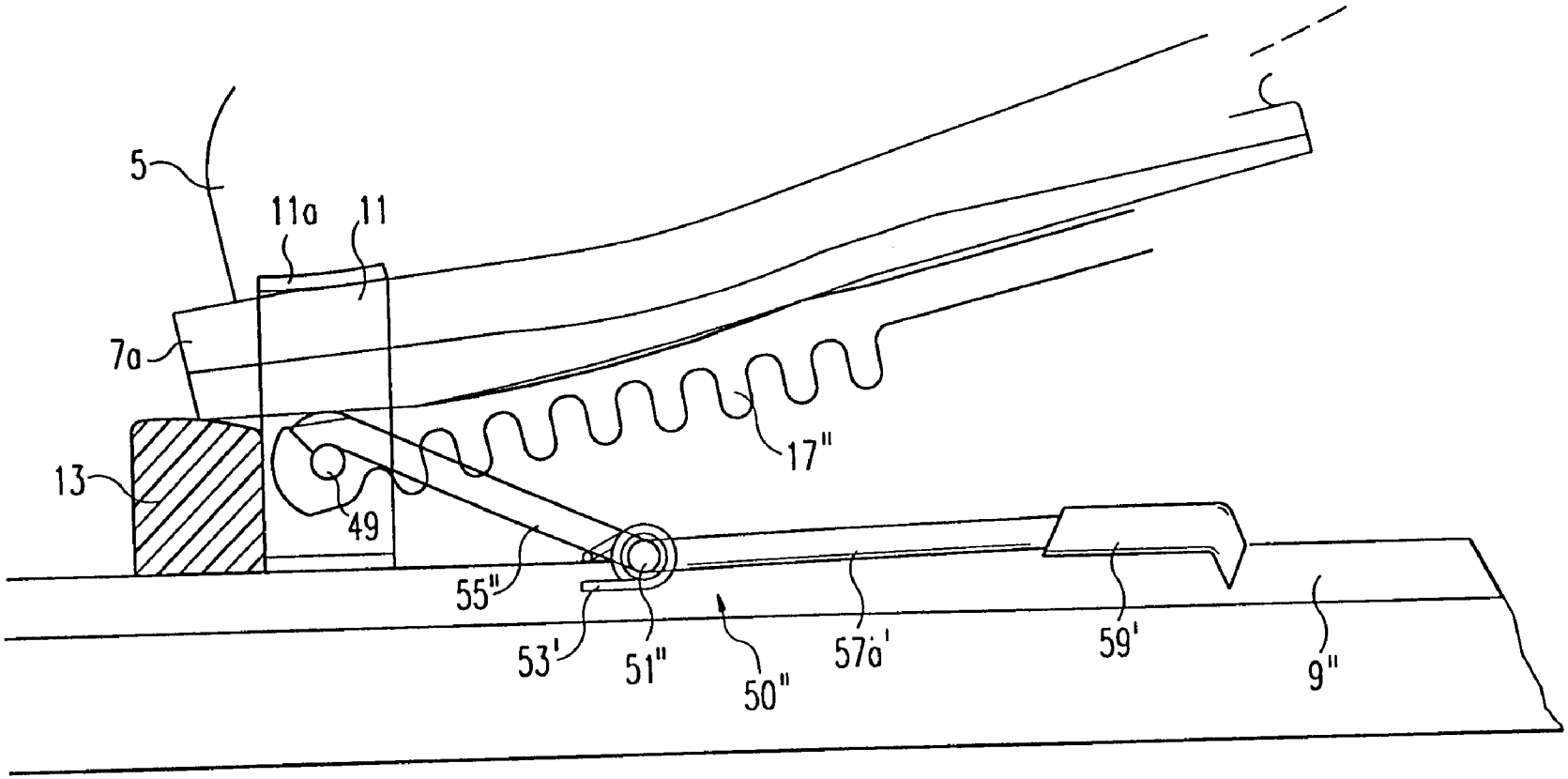
Figure 7C:
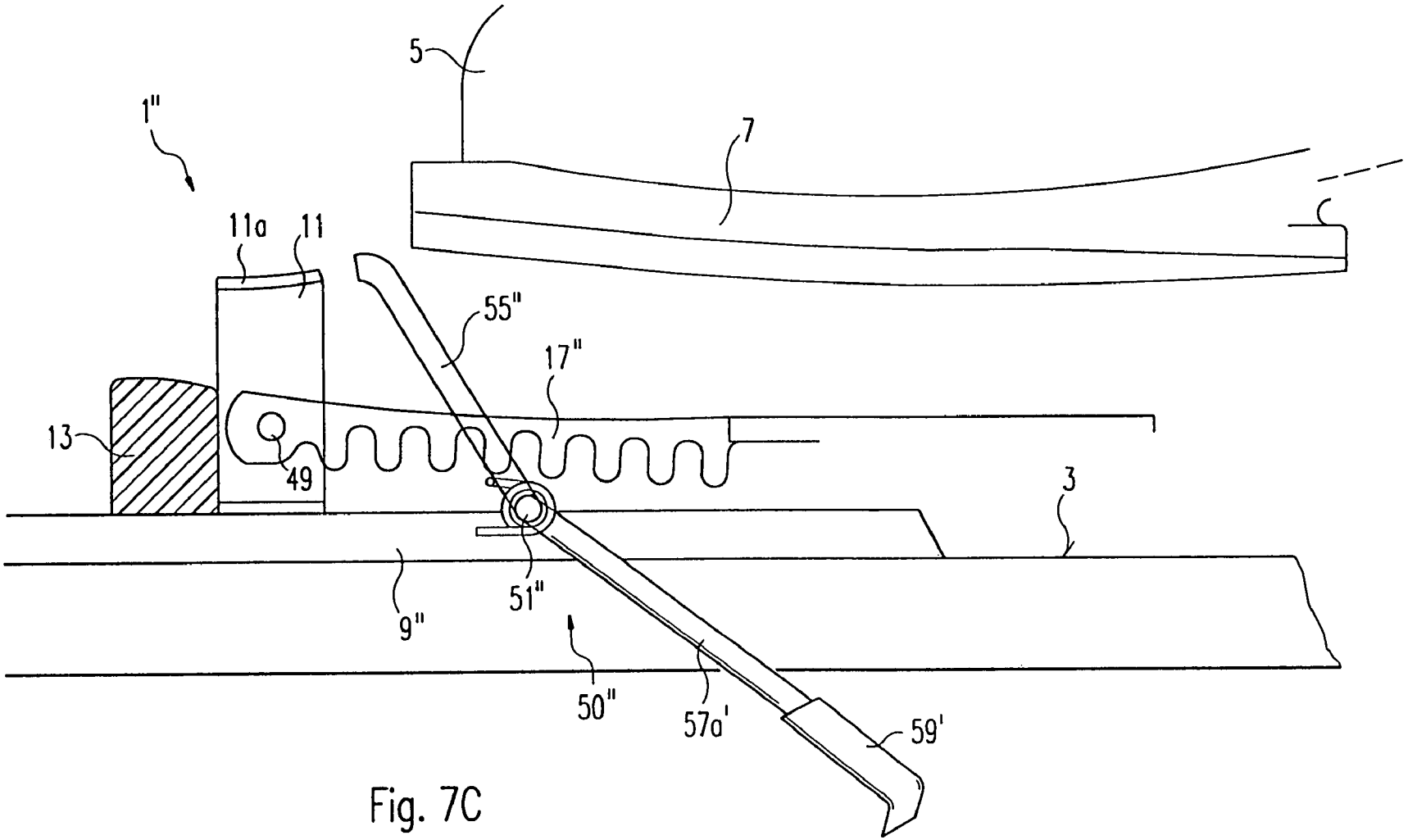

FIGS. 7A to 7C show the position of the ski binding 50" when the ski boot 5 is in various positions within the binding 1". It is evident that when the boot 5 is resting flat on the ski or the mounting plate 9" (FIG. 7A), just as when the heel of the boot is raised, the front end of the front section 55" of the ski brake 50" is clamped between the underside of the front sole 7 and the fixation and rotation axle 49, as a result of which the ski brake is kept in its inactive position, with its lateral branches 57*a*', 57*b*' oriented parallel to the upper surface of the ski. Only after the boot 5 has left the binding 1" (FIG. 7C) is the front section 55" released and the whole ski brake 50" rotated about its axle 51" under the action of the torsion spring 53'. The result is that the ski brake is put into the active position shown in the drawing, in which the lateral branches 57*a*', 57*b*' are at an acute angle to the plane of the ski and the plastic pads 59' brake the ski.

The implementation of the invention is not restricted to the examples described above but is also possible in a large number of further modifications, which are within the scope of a person skilled in the art.

LIST OF REFERENCE NUMERALS

1; 1'; 1" Ski binding
3 Upper surface of ski
5 Ski boot
7 Front part of sole
7*a* Edge of sole
7*b* Back end of sole
9; 9" Mounting plate
11 Front retaining element (retaining clamp)
11*a* Tilted edge
13 Elastic pressing element (elastomer block)
15 Back retaining mechanism
17; 17'; 17" Flexible plastic plate
17*a*'; 17*a*" Longitudinal slot
19 Unlocking device
21 Back retaining element (pivoted lever)
23 Pair of rollers
25 Back spring device
27 Housing for retaining mechanism
29 Adjustment screw
31 First locking element (pivoted lever)
31*a* Tilted edge
33 Second locking element (sliding piece)
33*a*; 33*b* Tilted edge
35 Axle
37 Holder
39 Coil spring (torsion spring)
41 Ski pole
43 Guide opening
45 Front binding case
47 Front spring device (coil spring)
49 Fixation and rotation axle
50'; 50" Ski brake (pivoted lever)
51'; 51" Axle
53' Torsion spring
55'; 55" Front section
57*a*';. 57*b*' Lateral branches
59' Plastic pad

The invention claimed is:

1. A ski binding (1; 1'; 1"), for use with a boot having a sole with a front end and a heel used with a touring, telemark or cross-country ski, comprising:

a front retaining portion (11) associated with the front sole end (7*a*) of a ski boot (5), a back retaining portion (21) so constructed that it engages an edge (7*b*) at the front part of the boot sole or at the heel of the boot, a tensioning device (17; 25; 47; 17'; 17") having a flat flexible connecting part (17) with spring elasticity that connects the front and back retaining portions to one another, and that allows said front and back retaining portions to be locked to the ski boot while allowing the heel of the boot to be raised away from the ski, and a ski brake (50'; 50") having an actuating section 55'; 55") with a pivot portion (51'; 51";53') disposed between the upper surface (3) of the ski and said flat connecting part (17; 17'; 17"), and side branches (57*a*'; 57*b*') connected to the actuating section such that when the binding is in use, a front portion of said actuating section (55'; 55") of the ski brake is in direct contact with the underside of the front end of the sole (7) of the ski boot (5) in the region of the front retaining portion (11), in such a way that when the heel of the ski boot (5) is raised, the ski brake remains in a resting position on the ski with the front portion of the actuating section being still fixed between the underside of the front end of the sole (7) and an upper surface of the flat connecting part (17), and so that when the front end (7*a*) is fixed in said front retaining portion, the ski brake is inactive, and the ski brake is activated when the front end of the boot is removed from said front retaining portion (11).

2. A ski binding for use with a boot having a sole with a front end and a heel and used with a touring, telemark or cross country ski comprising:

a retaining element having a front portion in the form of a substantially U-shaped resilient retaining clamp fixedly attached to the ski with the legs of said U-shaped retaining clamp extending upwardly and bending inwardly towards each other and engaging the front end of the boot with a lateral resilience enabling the front end of the boot to be rotatably released from the binding when torsional force between the ski and the boot is unacceptably high, and said retaining element having a back portion engaging the front of the boot sole or the heel, a flexible tensioning device connecting said front portion and back portion so that said front and back portions can be locked to the boot and when locked to the boot, the heel can be lifted away from the ski and, an elastic element fixed to the ski, disposed forward of said front portion and engaged directly beneath a running surface of said sole of the boot so that the front end of the boot can be moved downwardly against said fixed elastic element while the boot heel is lifted away from the ski, the elastic element pressing the sole of the boot against the retaining clamp.

* * * * *